United States Patent [19]

Abildgaard

[11] Patent Number: 4,722,626

[45] Date of Patent: Feb. 2, 1988

[54] DOCUMENT BINDING STRIPS AND FILE SUSPENSION

[75] Inventor: William H. Abildgaard, Redwood City, Calif.

[73] Assignee: VeloBind, Inc, Sunnyvale, Calif.

[21] Appl. No.: 871,828

[22] Filed: Jun. 9, 1986

Related U.S. Application Data

[63] Continuation-in-part of Ser. No. 798,872, Nov. 18, 1985, Pat. No. 4,674,906, which is a continuation-in-part of Ser. No. 663,214, Oct. 22, 1984, Pat. No. 4,685,700.

[51] Int. Cl.[4] ..... B42F 13/40; B42F 17/00; B42B 3/14; A47B 63/00

[52] U.S. Cl. ..... 402/4; 402/80 P; 412/43; 312/184

[58] Field of Search ..... 402/4, 14, 18, 15, 60, 402/64, 80 P; 412/43; 312/183, 184, 187, 189, 192; 40/18

[56] References Cited

U.S. PATENT DOCUMENTS

| | | | |
|---|---|---|---|
| 3,312,515 | 4/1967 | Barker | 312/184 |
| 3,744,821 | 7/1973 | Abildgaard | 412/43 |
| 3,850,488 | 11/1974 | Elias et al. | 402/4 |
| 4,181,381 | 1/1980 | Amand | 312/184 |
| 4,232,918 | 11/1980 | Leber | 312/184 |

FOREIGN PATENT DOCUMENTS

| | | | |
|---|---|---|---|
| 1203730 | 10/1965 | Fed. Rep. of Germany | 312/184 |
| 1191115 | 10/1959 | France | 402/80 P |
| 266901 | 5/1950 | Switzerland | 312/184 |

*Primary Examiner*—E. R. Kazenske
*Assistant Examiner*—Paul M. Heyrana, Sr.
*Attorney, Agent, or Firm*—Julian Caplan

[57] ABSTRACT

Binding strips are used to bind punched paper. A first strip has studs fitting through the holes in the paper and in a second strip. In one form of the invention the studs are flexible and are bent over to snap into grooves in the second strip so that the studs may be unbent to add or remove paper. In another, more permanent, form the studs may be cut off and riveted to the second strip. One of the strips or an intermediate strip has lateral ears formed with hooks which fit over the conventional parallel bars of suspension-type file drawers. One of the strips may be formed with file tabs to indicate the subject matter of the bound paper. Such file tab may be notched to facilitate removal of a pressure-sensitive label affixed to the tab.

11 Claims, 14 Drawing Figures

DOCUMENT BINDING STRIPS AND FILE SUSPENSION

CROSS-REFERENCES TO RELATED APPLICATIONS

This application is a continuation-in-part of copending application Ser. No. 06/798,872, filed Nov. 18, 1985, for bookbinding strips and method of binding strips, now U.S. Pat. No. 4,674,906, which is a continuation-in-part of application Ser. No. 06/663,214, filed Oct. 22, 1984, now U.S. Pat. No. 4,685,700. The subject matter of said prior applications is incorporated herein by reference.

BACKGROUND OF THE INVENTION

This invention relates to a new and improved document binding strip and file suspension. More particularly, the invention relates to bookbinding strips which may be used to bind together the spine edges of punched paper, one of the strips or an intermediate strip having laterally extending ears preferably formed with hooks which fit over the parallel bars used in suspension filing.

Description of Related Art

Two general classes of binding strips may be incorporated in the strips of the present invention. Thus pairs of plastic strips such as those shown in U.S. Pat. No. 4,369,013 may be used, such strips being characterized by the fact that the studs are relatively rigid during the binding operation, are cut to remove excess length and rivet heads are formed thereon.

Another type of binding system is shown in co-pending application Ser. No. 798,872 and its parent application Ser. No. 663,214 wherein the studs are flexible and when bent over when bent over snap into grooves formed in one of the strips.

Suspension filing systems are well known. Such systems are incorporated in various types of file cabinets and drawers and bins. On either side of the drawer is a bar. File folders have extending ears which hook over the bars to suspend the file folder and its contents, rather than the file folders resting on the bottom of the drawers as in older types of filing systems. Generally speaking, the file folders have required that the ears and hooks be positioned on either end of both upper edges of the folder. Papers have to be placed in the folders loose or bound into the folder by various means. The present invention differs from such file suspension means in that, instead of folders being required, ears and hooks are formed on the lateral edges of the binding strips which bind the papers together or an intermediate strip and these ears are used to suspend the bound papers from the suspension bars.

SUMMARY OF THE INVENTION

A pair of plastic strips is used in accordance with the present invention. The first strip has studs protruding therefrom which fit into mating holes in the spine edges of the papers to be bound. A second strip has holes to receive the studs. In a preferred form of the invention, the studs are flexible and a second strip is formed on its back surface with grooves having overhanging lips into which the bent-over studs snap, all as explained in detail in application Ser. No. 798,872. In another form of the invention, the studs 22 are relatively rigid and thermoplastic. The second strip is formed with counterbores aligned with the holes. By means of a hot knife or other instrumentality the excess lengths of the studs are cut off and rivet heads formed, filling the counterbores.

A characteristic of the present invention is the fact that one of the binding strips, or an intermediate strip which is bound intermediate the papers being bound, is formed with laterally extending ears shaped as hooks to fit over the suspension bars of a conventional suspension filing system. Thus, the papers are supported from the suspension bars without the need of file folders.

One of the strips also is provided with an identification tab on which the subject matter of the papers may be displayed by application of a pressure sensitive adhesive label. Such tabs are preferably slanted backwards to conserve space and to make the identification more readily legible.

Other objects of the present invention will become apparent upon reading the following specification and referring to the accompanying drawing in which similar characters of reference represent corresponding parts in each of the several views.

Figure 7:
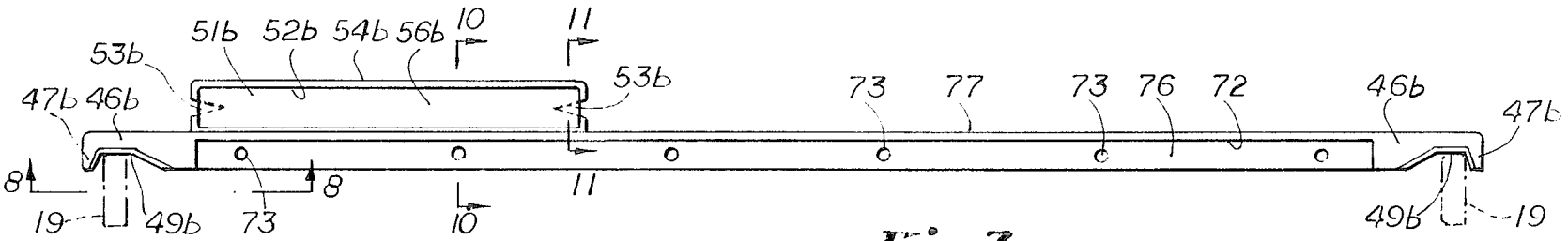
FIG. 7 is a front elevational view of an intermediate member used in another modification of the invention.
Figure 10:
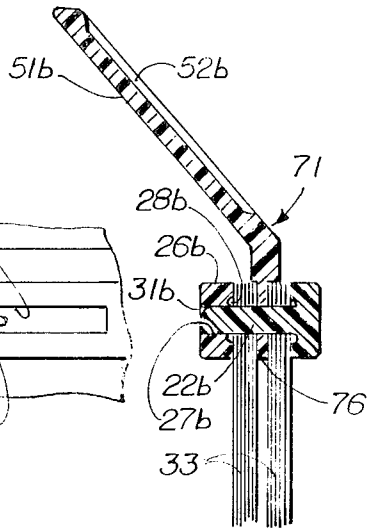
Figure 9:
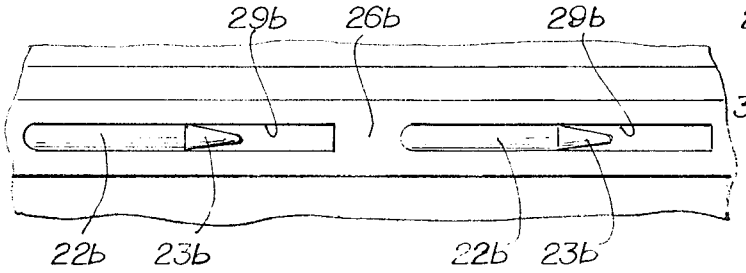
FIG. 9 is a view similar to FIG. 5 of the modification of FIG. 7.
Figure 8:
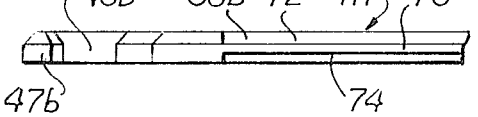
FIG. 8 is an enlarged fragmentary bottom plan of a portion of the structure of FIG. 7.
Figure 11:
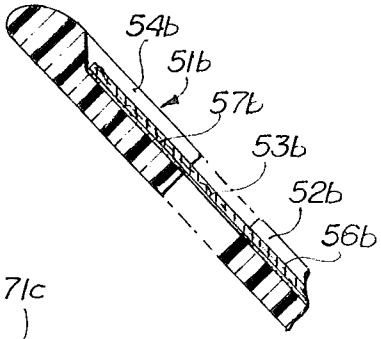

FIGS. 10 and 11 are enlarged sectional views taken substantially along lines 10—10 and 11—11 of FIG. 7.

Figure 5A:
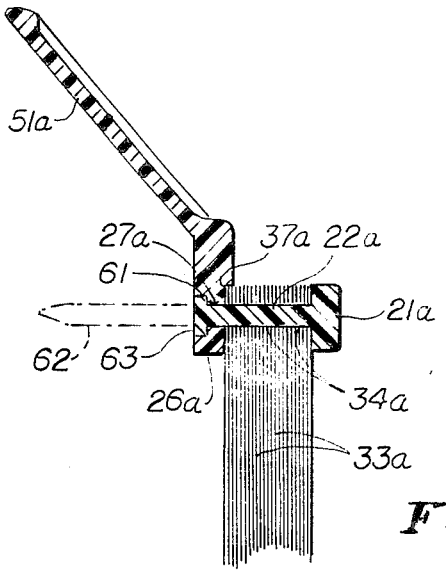
FIG. 5A is a view similar to FIG. 5 of a modification.
Figure 6:
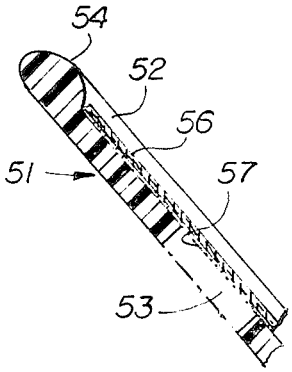
FIG. 6 is an enlarged fragmentary sectional view taken substantially along the line 6—6 of FIG. 2.
Figure 12:
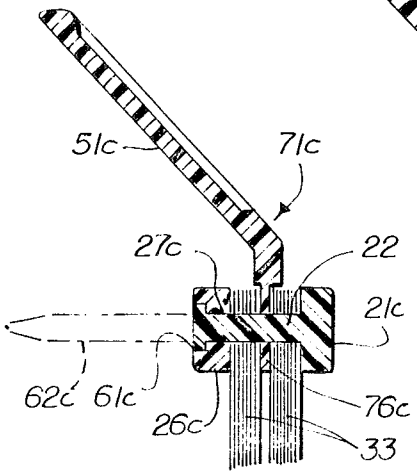

FIG. 12 is a view similar to FIG. 5A of a still further modification.

DESCRIPTION OF PREFERRED EMBODIMENTS

Figures 1, 2, 3, 4, 5:
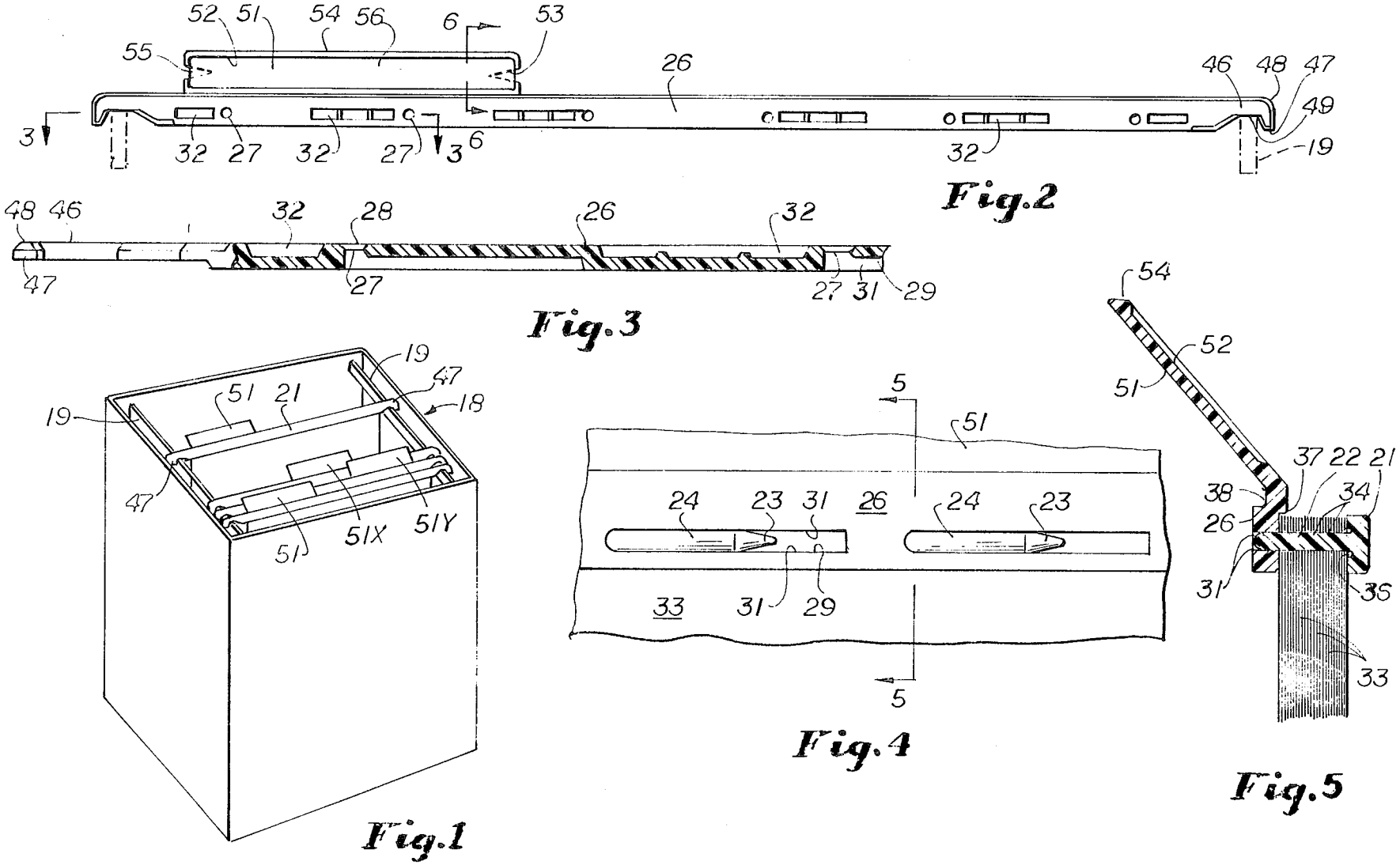
FIG. 1 is a schematic perspective view of a file box with which the present invention may be used.
FIG. 2 is a front elevational view of the second of the pair of strips used in the present invention.
FIG. 3 is an enlarged fragmentary sectional view taken substantially along the line 3—3 of FIG. 2.
FIG. 4 is a further enlarged fragmentary rear elevational view of the strip of FIG. 2 showing the device assembled.
FIG. 5 is an enlarged fragmentary sectional view showing the back of the assembly along the line 5—5 of FIG. 4.
Figure 2A:
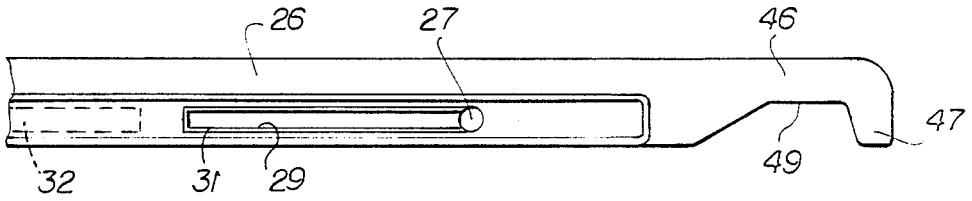
FIG. 2A is a fragmentary enlarged rear elevational view of a part of the structure of FIG. 2.

File drawer 18 shown in FIG. 1 is merely representative of a large number of different environments with which the present invention may be used. On either side and spaced slightly inwardly from the sides but near the top of drawer 18 are longitudinal parallel suspension bars 19, usually rectangular in cross-section. In accordance with the present invention, strips are used to bind sheets together and one of the binding strips or a separate strip has ears which rest upon the bars 19 to suspend the sheets from the bars, rather than the folders resting on the bottom of the drawer 18.

Turning first to the form of the invention shown in FIGS. 2–5, first strip 21 (see FIG. 5) is of a thin narrow plastic material. Integral therewith at spaced intervals along strip 21 are flexible plastic studs 22, having pointed ends 23. The material of the studs 22 may be of polypropylene, K-resin and any of a group of thermoplastic elastomers. The stud length is considerably greater than the thickness of the pages to be bound and the excess length is bent over. The flexible nature of the material of which the studs 22 are formed, makes it possible to bend the studs at a relatively abrupt angle. The second strip 26 is likewise preferably of plastic and is formed with spaced holes 27 complementary to the spacing of the studs 22. To facilitate the tips 23 being inserted in holes 27, the bottom surface of strip 26 is preferably formed with the countersink or counterbore 28 around each hole 27. The tops of the strip 26 are formed with longitudinally extending grooves 29 extending away from holes 27 to receive the bent stud portions 24. As shown in FIG. 2, there may be six holes 27, the grooves 29 associated with the three on the left extending toward the right and the three on the right extending toward the left, but it will be understood that this arrangement is subject to variation as is the number of studs.

Grooves 29 are formed with overhanging lips 31 along each upper edge. Thus, the bent over portions 24 of studs 22 snap between the lips 31 and are retained in place thereby. The length of each groove 29 is preferably slightly longer than stud 22 to permit a debinding tool to enter groove 29 and engage end 23 to pull the stud away from the groove 29 when it is desired to unbend the stud in order to add or remove sheets 33.

Since strips 21 and 26 are preferably manufactured in large quantities by injection molding, the parts are subject to shrinkage. Thus, reliefs 32 are formed in the surface of strip 26 opposite grooves 29 to reduce shrinkage problems by making the thickness of strips 26 relatively uniform and also to reduce the quantity of plastic required.

To facilitate sharp bending of the stud 22, a depression 36 may be formed in the back surface of strip 21 surrounding the stud 22.

Strip 26 on its formed face may be forward with a depression 37 extending across the width of the strip into which the edges of some of the sheets 33 to be bound fit. It will be understood that holes 24 are punched in the sheets 33 at the same intervals as the studs 22. However, the distance between holes 34 and the spine (upper) edge of sheet 33 is subject to variation depending upon the style punch used. The depression 37 accommodates sheets having holes punched different distances from the ends.

As best shown in FIG. 5, a depression 38 may be formed in the back of strip 26. As is shown in pending application Ser. No. 776,207, filed Sept. 16, 1985, a convenient means for bending the studs 22 so that the bent ends 24 snap into the grooves 29, is to draw a tool longitudinally along the strip 26, the tool having a pocket into which the strip 26 fits and projections of the tool fitting over the longitudinal edges of the strip 26. The depression 38 makes it possible to use such a binding tool with strip 26 of the present invention.

As shown in FIG. 5A, instead of a flexible stud 22 being employed the studs **22*a* are relatively rigid and thermoplastic. The studs 22*a* are inserted through the holes 34*a* in sheets 33*a* to be bound and also through holes 27*a* in the second strip 26*a*. A counterbore 61 surrounds the hole 27*a* in strip 26*a*. The excess stud length 62 is cut off and a rivet head 63 formed filling the counterbore 61**.

In both the form of the invention shown in FIGS. 2–5 and the form shown in FIG. 5A, a strip 26 on either end has a lateral projection or ear 46 formed on its underside with a cut-out 49 (see FIG. 3A) having a width equal to the thickness of bar 19. This provides a hook 47 which fits over the outside of the bar 19 and holds the assembly properly aligned. Preferably, a reinforcing rim 48 is formed around the top edge of strip 26 and the hook 47 to rigidify the strip. It will be understood that ears 46 may be formed on strip 21 instead of strip 26.

One of the strips (either 21 or as here shown, 26) is provided with a tab 51. As best shown in FIG. 1, the tabs may be spaced different distances from the ends of the strips as is quite common in the location of index tabs in conventional filing folders. Thus, the tab 51 is located on the left edge of one of the strips 21 while the tab **51*x* is in the middle and the tab 51*y* on the right. Tabs 51 are preferably slanted backward at an angle of approximately 40° from the vertical to make the writing on the tabs more legible. The arrangement of tabs is subject to considerable variation. The forward or upper face of tab 51 is perferably formed with a depression 52 surrounded by a rim 54. A paper label 56 is affixed in the depression by pressure sensitive adhesive 57. A notch 53 is formed on one or both edges of tab 51 to facilitate removing the label 56** if required.

In use of the device of FIGS. 1–5, papers 33 are punched with holes 34. The studs 22 of first strip 21 are inserted through the holes 34 and through the holes 27 and the strips 26, 21 pressed together. The excess lengths of the studs are bent at right angles as indicated by reference numeral 24, the bent over portions 24 snapping into the grooves 29 under the lips 31. Thereupon, the pressure sensitive label 56 may be applied in the depression 52 to indicate the contents of the papers 33. The sheets 33 are then positioned in the file drawer 18, the ears 46 resting on top of the suspension bars 19 and the hooks 47 positioned outside the suspension bars 19.

In the form of the invention shown in FIGS. 2–5 if it is necessary to remove or add sheets 33, the ends 23 of the bent over portions 24 of studs 22 are raised so that the studs 22 are substantially straight, permitting the strip 26 to be removed. Whatever rearrangement or addition of pages 33 is desired is readily accomplished and the same studs 22 are reused. If necessary, the label 56 may be removed by inserting a pencil or other instrumentality in the notch 53 and pulling the label 56 out of the depression 52.

As indicated in FIG. 5A, instead of a relatively loose-leaf bind, a more permanent bind may be made by using strips **21*a* having relatively rigid theremoplastic studs 22*a*. When the sheets 33*a* are assembled on the studs 22*a*, the studs 22*a* are inserted through the holes 27 and the strips 21*a*, 26*a* pressed toward each other. Thereupon, the excess stud lengths 62 are cut off and rivet heads 63 formed, filling the counterbores 61. In other respects, the modification of FIG. 5A** resembles that of the preceding figures and the same reference numerals followed by the subscript a are used to designate corresponding parts.

Directing attention to FIGS. 7–11, instead of the ears and tabs being formed on one of the binding strips 21 or 26, a separate intermediate member 71 is used and the male and female strips **21*b*, 26*b* are formed without ears or tabs. Intermediate strip 71 is formed with a quite thin blade portion 76 which is inserted in the stack of sheets 33, preferably in the middle of the stack so that, when suspended, the stack tends to remain upright. The position of blade 76** in the stack may be on the top or bottom of the stack or any intermediate position.

To achieve the thin dimension of blade 71, a front depression 72 and rear depression 74 extending the length of sheets 33 is formed on member 71. Depressions 72, 74 extend up to a line near the top so that there is a rim 77 at the top against which the spine edges of sheets 33 may fit. Holes 73 are formed in blade 76 at the same intervals as studs **22*b* of male binding strip 21*b***.

Member 71 has ears **46*b*, hooks 47*b* and cut-outs 49*b* resembling the corresponding elements in the structure of FIGS. 2–5. Further, a tab 51d may be formed integral with member 71**.

In use of the structure shown in FIGS. 7–11, approximately one-half of a stack of punched sheets 33 is installed on strip **21*b*, studs 22*b* fitting into holes 34. Then member 71 is installed, the studs 22*b* fitting in holes 73. The remainder of the stack of sheets 33 is then installed by inserting studs 22*b* through holes 34. The strip 26*b* is added by inserting studs 22*b* through holes 27*b* and the strips 26*b* and 21*b* are compressed together. Thereupon, the ends of studs 22*b* are bent down into grooves 29*b*, snapping under lips 31*b*. When the ears 46*b* are placed over bars 19**, the bound documents tends to hang vertically.

In FIG. 12, the member **71*c* is identical with the blade 71 of FIGS. 7–11. Strips 21*c* and 26*c*, however, are similar to the modification of FIG. 5A, except for the absence of ears and tab 51*a***.

In other respects the modifications of FIGS. 7–11 and 12 resemble those of FIGS. 1–6 and 5A, respectively, in structure and use and the same reference numerals followed by subscripts b and c, respectively, designate corresponding elements.

What is claimed is:

1. A combination binder and file suspension of a core of sheets formed with a series of first holes spaced along one edge comprising a first strip overlying the spine edge of said core on one side of said book having a plurality of integral round, smooth, flexible plastic studs integral with said first strip and bendable at approximately a 90° angle spaced the same intervals as said first holes extending outward of said first strip;

a second strip overlying the spine of said core on the side of said book opposite said first strip formed with a plurality of second holes spaced the same intervals as said first holes, and for each said second hole a separate, smooth-walled groove in the outer surface of said second strip communicating with and extending away from said second hole and being of a length slightly longer than the length of said studs, each said groove having stud retaining means comprising at least one smooth-surfaced overhanging lip extending longitudinally substantially the entire length of said groove adjacent only the outside of said groove;

one of said strips being formed at either end with laterally extending ears shaped to fit over and suspend said combination from parallel, spaced file suspension bars whereby each said stud may be inserted extending outward of said first strip through said first holes in said core and one said second hole and bent at approximately a 90° angle and snapped down into one said groove and under said overhanging lip so that said stud is held in place in said groove.

2. The combination of claim 1 in which at least one said strips is formed with an integral upward projecting index tab.

3. The combination of claim 2 in which said tab is formed with a depression shaped to receive an identifying label.

4. The combination of claim 3 which further comprises a lable secured by adhesive within said depression.

5. The combination of claim 4 in which one edge of said tab is formed with a notch for easy removal of said label.

6. The combination of claim 1 in which one face of said second strip is formed with a depression to receive edges of superimposed sheets.

7. A method for suspending bound papers in a file drawer of the type having parallel suspension bars along the top of and spaced inward from the sides of said drawer comprising providing a core of a plurality of sheets, each sheet having at least four first holes spaced apart longitudinally and inwardly of the spine edges of said sheets; a first strip overlying the spine edge of said core on one side of said book having a plurality of round, integral smooth, flexible plastic studs integral with said first strip and bendable at approximately a 90° angle spaced the same intervals as said first holes extending outward of said first strip; and a second strip overlying the spine of said core on the side of said book opposite said first strip formed with a plurality of second holes spaced the same intervals as said first holes, and for each said second hole a separate, smooth-walled groove in the outer surface of said second strip communicating with and extending away from said second hole and being of a length slightly longer than the length of said studs, each said groove having stud retaining means comprising at least one smooth-surfaced overhanging lip extending longitudinally substantially the entire length of said groove adjacent only the outside of said groove;

one of said strips being formed at either end with laterally extending ears shaped to fit over and suspend said sheet from parallel, spaced file suspension bars;

assembling said sheets in a core with said first holes aligned;

inserting each said stud through aligned first holes in said core and one said second hole;

bending each said stud at approximately a 90° angle and snapping each said stud down into one said groove and under said overhanging lip so that said stud is held in place in said groove, and suspending the bound sheets from said bars by means of said ears.

8. The method of claim 7 in which at least one said strips is formed with an upward projecting index tab and which further comprises applying identifying indicia to said tab.

9. A method for suspending bound papers in a file drawer of the type having parallel suspension bars along the top of and spaced inward from the sides of said drawer comprising punching sheets with a series of holes along one edge and assembling said sheets in a stack;

providing a first strip having longitudinally spaced studs projecting therefrom at intervals equal to the spacing of the holes in the sheets and dimensioned to fit through the holes, said studs being bendable, a second strip formed with apertures spaced and shaped to receive said studs, said second strip being formed on one surface with grooves communicating with said apertures shaped to receive bent over studs to detachably bind said strips together, and a third strip having second apertures spaced and shaped to receive said studs formed with laterally extending ears shaped to fit over and suspend said stack from parallel, spaced file suspension bars;

assembling said first strip on one side of said stack and said second strip on the opposite side of said stack and said third strip between said sheets in said stack with said holes and apertures aligned;

inserting said studs through said holes and then said apertures;

compressing said first and second strips toward each other;

binding said first and second strips together;

and suspending said stack from said bars by means of said ears.

10. A combination binder and file suspension of a core of sheets formed with a series of first holes spaced along one edge comprising a first strip overlying the spine edge of said core on one side of said book having a plurality of integral round, smooth, flexible plastic studs integral with said first strip and bendable at approximately a 90° angle spaced the same intervals as said first holes extending outward of said first strip;

a second strip overlying the spine of said core on the side of said book opposite said first strip formed with a plurality of second holes spaced the same intervals as said first holes, and for each said second hole a separate, smooth-walled groove in the outer surface of said second strip communicating with and extending away from said second hole and being of a length slightly longer than the length of said studs, each said groove having stud retaining means comprising at least one smooth-surfaced overhanging lip extending longitudinally substantially the entire length of said groove adjacent only the outside of said groove;

and a third strip having second apertures spaced and shaped to receive said studs formed with laterally extending ears shaped to fit over and suspend said combination from parallel, spaced file suspension bars;

one of said strips being formed at either end with laterally extending ears shaped to fit over and suspend said combination from parallel, spaced file suspension bars;

whereby each said stud may be inserted extending outward of said first strip through said first holes in said core and one said second hole and bent at approximately a 90° angle and snapped down into one said groove and under said overhanging lip so that said stud is held in place in said groove.

11. A method for suspending bound papers in a file drawer of the type having parallel suspension bars along the top of and spaced inward from the sides of said drawer comprising providing a core of a plurality of sheets, each sheet having at least four first holes spaced apart longitudinally and inwardly of the spine edges of said sheets; a first strip overlying the spine edge of said core on one side of said book having a plurality of round, integral smooth, flexible plastic studs integral with said first strip and bendable at approximately a 90° angle spaced the same intervals as said first holes extending outward of said first strip; a second strip overlying the spine of said core on the side of said book opposite said first strip formed with a plurality of second holes spaced the same intervals as said first holes, and for each said second hole a separate, smooth-walled groove in the outer surface of said second strip communicating with and extending away from said second hole and being of a length slightly longer than the length of said studs, each said groove having stud retaining means comprising at least one smooth-surfaced overhanging lip extending longitudinally substantially the entire length of said groove adjacent only the outside of said groove; and a third strip having second apertures spaced and shaped to receive said studs formed with laterally extending ears shaped to fit over and suspend said combination from parallel, spaced file suspension bars;

one of said strips being formed at either end with laterally extending ears shaped to fit over and suspend said combination from parallel, spaced file suspension bars;

assembling said sheets in a core with said first holes aligned;

inserting each said stud through aligned first holes in said core and one said second hole;

bending each said stud at approximately a 90° angle; and snapping each said stud down into one said groove and under said overhanging lip so that said stud is held in place in said groove;

and suspending said stack from said bars by means of said ears.

* * * * *